United States Patent [19]

Trenne

[11] 4,427,151

[45] Jan. 24, 1984

[54] FUEL INJECTOR

[75] Inventor: Myron U. Trenne, Rochester, Mich.

[73] Assignee: General Motors Corporation, Detroit, Mich.

[21] Appl. No.: 15,947

[22] Filed: Feb. 28, 1979

[51] Int. Cl.[3] ..... F02M 49/02

[52] U.S. Cl. ..... 239/87; 123/501; 239/533.12; 239/585

[58] Field of Search ..... 239/87, 533.3–533.9, 239/533.11, 533.12, 585; 123/139 E, 139 AJ, 139 A, 499, 501, 478

[56] References Cited

U.S. PATENT DOCUMENTS

| | | | |
|---|---|---|---|
| 2,703,562 | 3/1955 | Seubert, Jr. | 123/139 AJ |
| 2,740,667 | 4/1956 | Dickson et al. | 123/139 AJ |
| 2,740,668 | 4/1956 | Paluch et al. | 239/87 |
| 2,917,034 | 12/1959 | Bessiere | 239/87 |
| 2,982,277 | 5/1961 | May, et al. | 123/139 AJ |
| 4,129,256 | 12/1978 | Bader et al. | 123/139 E |
| 4,244,342 | 1/1981 | Fenne | 239/87 |

FOREIGN PATENT DOCUMENTS

| | | | |
|---|---|---|---|
| 1042295 | 10/1958 | Fed. Rep. of Germany | 239/533.3 |

*Primary Examiner*—John J. Love
*Assistant Examiner*—Michael J. Forman
*Attorney, Agent, or Firm*—C. K. Veenstra

[57] ABSTRACT

An injector for delivering fuel directly to an engine combustion chamber has a sleeve which responds to the combustion chamber pressure and cooperates with a piston in the injector to pressurize the fuel. A single valve in the injector is controlled both to permit supply of fuel to the injector and to allow injection at the appropriate time and in an appropriate amount.

6 Claims, 2 Drawing Figures

FUEL INJECTOR

TECHNICAL FIELD

This invention relates to an injector for delivering fuel directly to an engine combustion chamber.

BACKGROUND

When delivering fuel directly to an engine combustion chamber, the fuel must be highly pressurized both to overcome the pressure in the combustion chamber and to assure that the fuel is properly atomized and disbursed in the combustion chamber. In one form of injector proposed for this purpose, a sleeve responsive to combustion chamber pressure cooperates with a stationary piston in the injector to create the high pressure. Before this invention, however, such injectors required complex valve arrangements to permit supply of fuel to the injector and to allow injection at the appropriate time and in an appropriate amount.

SUMMARY OF THE INVENTION

This invention provides an injector having a sleeve that responds to the combustion chamber pressure and cooperates with a piston in the injector to pressurize the fuel and which also has a single valve controlled both to permit supply of fuel to the injector and to allow injection at the appropriate time and in an appropriate amount.

The details as well as other features and advantages of this invention are set forth in the remainder of the specification and are shown in the accompanying drawing.

BEST MODE FOR CARRYING OUT THE INVENTION

Figure 1:
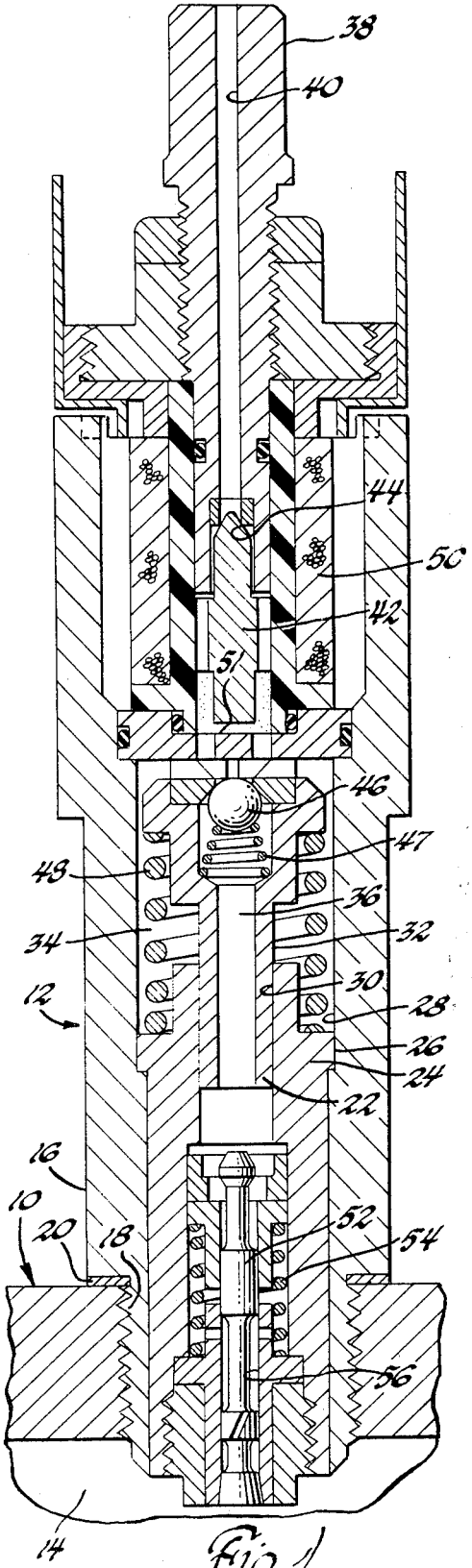
FIG. 1 is a sectional elevational view of one embodiment of an injector employing this invention.

Referring first to FIG. 1, an engine cylinder head 10 has an injector 12 opening into the combustion chamber 14. The housing 16 of injector 12 is threaded at 18 for mounting on head 10, and a gasket 20 is retained between housing 16 and head 10.

A piston 22 is centrally located in housing 16, and a sleeve 24 is disposed in housing 16 and includes an outer surface 26 which slides along the inner surface 28 of housing 16 and an inner surface 30 which slides along the outer surface 32 of piston 22. A control chamber 34 is formed between sleeve 24 and housing 16, and a delivery chamber 36 is formed between sleeve 24 and piston 22.

Housing 16 also includes an extension 38 which contains a supply passage 40. A valve 42 is disposed in supply passage 40 and opens when the pressure in supply passage 40 exceeds the pressure in control chamber 34 to allow fuel to fill control chamber 34. However, when the pressure in control chamber 34 exceeds the pressure in supply passage 40, valve 42 is biased to engage a seat 44 in supply passage 40 and thus obstruct fuel flow from control chamber 34 to supply passage 40.

Simultaneously with filling of control chamber 34, a ball check valve 46 is displaced against its spring 47 to permit filling of delivery chamber 36.

Upon an increase in pressure in combustion chamber 14, sleeve 24 tends to rise against the bias of its spring 48. However, fuel is trapped in control chamber 34, and its pressure increases to offset the increase in combustion chamber pressure and prevent motion of sleeve 24.

Valve 42 is magnetically responsive and is associated with a solenoid coil 50. When coil 50 is energized, a magnetic field is created which moves valve 42 against its bias to engage a stop 51, thus permitting the fuel in control chamber 34 to flow back into supply passage 40. Thus while coil 50 is energized, the combustion chamber pressure may lift sleeve 24 against its spring 48. As sleeve 24 is lifted, it slides relative to piston 22 to increase the pressure in delivery chamber 36, ball check valve 46 closes, and the increased delivery chamber pressure displaces an injection valve 52 against the bias of its spring 54 and allows fuel flow through a delivery passage 56 into combustion chamber 14.

When solenoid coil is deenergized, valve 42 is moved against its seat 44 and the motion of sleeve 24 is stopped to terminate injection.

It may be noted that extension 38 is adjustable relative to the remainder of housing 16 so that the position of seat 44 may be adjusted relative to stop 51. This adjustment varies the opening between seat 44 and valve 42 when valve 42 engages stop 51 to control the rate of flow from control chamber 34 to supply passage 40; this adjustment thus controls the rate at which sleeve 24 may move and thereby establishes the rate of injection. Accordingly, this adjustment can be used to equalize the fuel delivery of one injector with that of another injector when both injector coils 50 are energized for the same period of time.

The advantages of an injector employing this invention are readily understood, for valve 42 controls both the supply of fuel to the injector, the timing of injection, and the amount of fuel injected.

Figure 2:
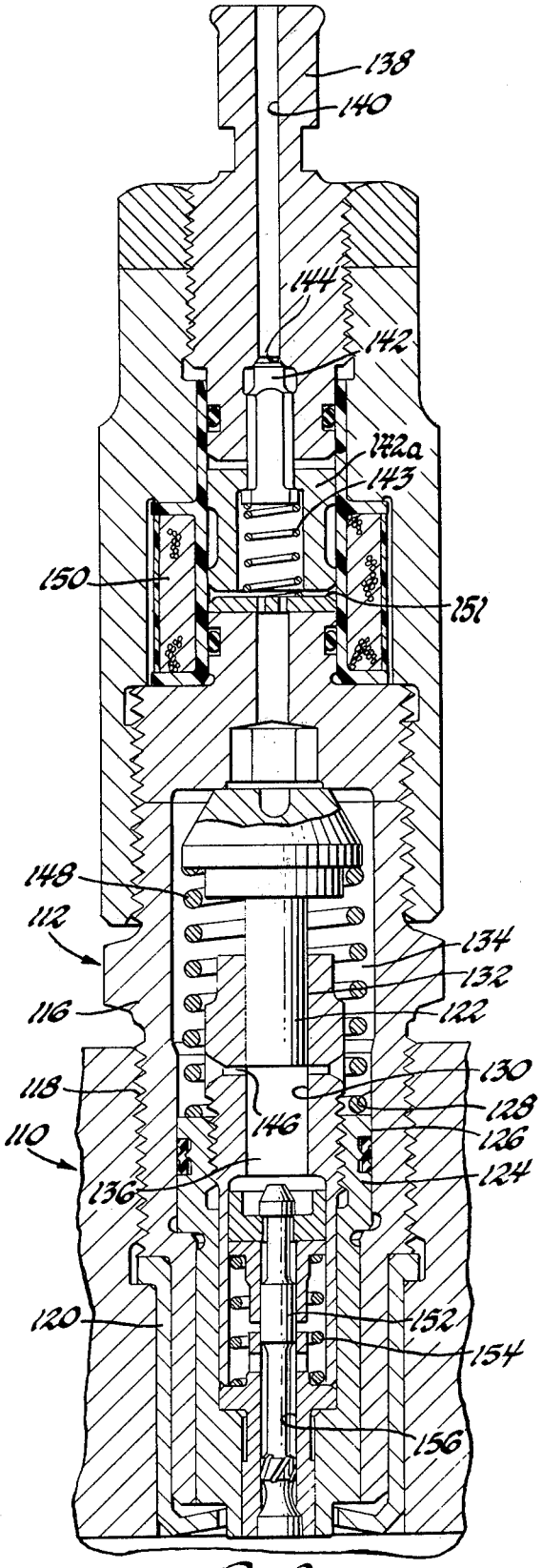
FIG. 2 is a sectional elevational view of another embodiment of an injector employing this invention.

FIG. 2 shows an alternative embodiment of an injector employing this invention. Referring to FIG. 2, an injector 112 has a housing 116 threaded at 118 for mounting on engine cylinder head 110, and a gasket 120 is retained between housing 116 and head 110.

A piston 122 is centrally located in housing 116, and a sleeve 124 is disposed in housing 116 and includes an outer surface 126 which slides along the inner surface 128 of housing 116 and an inner surface 130 which slides along the outer surface 132 of piston 122. A control chamber 134 is formed between sleeve 124 and housing 116, and a delivery chamber 136 is formed between sleeve 124 and piston 122.

Housing 116 also includes an extension 138 which contains a supply passage 140. A valve 142 is disposed in supply passage 140 and opens when the pressure in supply passage 140 exceeds the pressure in control chamber 134 to allow fuel to fill control chamber 134. However, when the pressure in control chamber 134 exceeds the pressure in supply passage 140, valve 142 is biased by a spring 143 to engage a seat 144 in supply passage 140 and thus obstruct fuel flow from control chamber 134 to supply passage 140.

A port 146 opens from control chamber 134 to delivery chamber 136 to permit filling of delivery chamber 136.

Upon an increase in pressure in combustion chamber 14, sleeve 124 tends to rise against the bias of its spring 148. However, fuel is trapped in control chamber 134, and its pressure increases to offset the increase in combustion chamber pressure and prevent motion of sleeve 124.

Valve 142 has a magnetically responsive armature 142*a* associated with a solenoid coil 150. When coil 150 is energized, a magnetic field is created which moves armature 142*a* downwardly to engage a stop 151, and armature 142*a* pulls valve 142 open to permit the fuel in control chamber 134 to flow back into supply passage 140. Thus while coil 150 is energized, the combustion chamber pressure may lift sleeve 124 against its spring 148. As sleeve 124 is lifted, it slides relative to piston 122, closing port 146 to increase the pressure in delivery chamber 136. The increased delivery chamber pressure displaces an injection valve 152 against the bias of its spring 154 and allows fuel flow through a delivery passage 156 into combustion chamber 14.

When solenoid coil is deenergized, valve 142 is moved against its seat 144 and the motion of sleeve 124 is stopped to terminate injection.

Extension 138 is adjustable relative to the remainder of housing 116 so that the position of seat 144 may be adjusted relative to stop 151. This adjustment varies the opening between seat 144 and valve 142 when armature 142*a* engages stop 151 to control the rate of flow from control chamber 134 to supply passage 140; this adjustment thus controls the rate at which sleeve 124 may move and thereby establishes the rate of injection. Accordingly, this adjustment can be used to balance the fuel delivery of one injector with that of another injector when both injector coils 150 are energized for the same period of time.

The embodiments of the invention in which an exclusive property or privilege is claimed are defined as follows:

1. An injector for delivering fuel directly to an engine combustion chamber, said injector including a housing, a piston in said housing, a sleeve closing one end of said housing and surrounding one end of said piston and thereby defining a control chamber between said sleeve and said housing and a delivery chamber between said sleeve and said piston, said sleeve having an end adapted for exposure to the pressure in said combustion chamber and being adapted to slide relative to said piston and said housing and thereby increase the pressures in said control and delivery chambers upon an increase in pressure in said combustion chamber, said housing having a supply passage connected to said control and delivery chambers for supplying fuel thereto, a magnetically responsive control valve disposed in said supply passage, said valve being responsive to the difference between the control chamber pressure and the supply passage pressure for obstructing flow from said control chamber to said passage upon an increase in the control chamber pressure, said sleeve having a delivery passage extending from said delivery chamber and adapted to open to said combustion chamber, an injection valve disposed in said delivery passage for inhibiting flow therethrough, said injection valve being responsive to the delivery chamber pressure for permitting delivery of fuel through said delivery passage to said combustion chamber upon an increase in the delivery chamber pressure, and a coil adjacent said control valve and energizable for creating a magnetic field to displace said control valve to permit flow from said control chamber to said supply passage, whereby the control chamber pressure may be reduced and the combustion chamber pressure may cause said sleeve to slide and thereby deliver fuel from said delivery chamber through said delivery passage to said combustion chamber while said coil is energized, and wherein said control valve is responsive to the difference between the supply passage pressure and the control chamber pressure for permitting flow from said supply passage to said control and delivery chambers upon a decrease in the control chamber pressure, whereby said control valve may be displaced to fill said control and delivery chambers with fuel without energizing said coil.

2. An injector for delivering fuel directly to an engine combustion chamber, said injector including a housing, a piston in said housing, a sleeve closing one end of said housing and surrounding one end of said piston and thereby defining a control chamber between said sleeve and said housing and a delivery chamber between said sleeve and said piston, said sleeve having an end adapted for exposure to the pressure in said combustion chamber and being adapted to slide relative to said piston and said housing and thereby increase the pressures in said control and delivery chambers upon an increase in pressure in said combustion chamber, said housing having a supply passage connected to said control and delivery chambers for supplying fuel thereto, a valve seat member disposed in said supply passage, a magnetically responsive control valve biased to engage said valve seat member and obstruct flow from said control chamber to said passage upon an increase in the control chamber pressure, said sleeve having a delivery passage extending from said delivery chamber and adapted to open to said combustion chamber, an injection valve disposed in said delivery passage for inhibiting flow therethrough, said injection valve being responsive to the delivery chamber pressure for permmitting delivey of fuel through said delivery passage to said combustion chamber upon an increase in the delivery chamber pressure, and a coil adjacent said control valve and energizable for creating a magnetic field to displace said control valve from said valve seat member against a stop and permit flow from said control chamber to said supply passage, whereby the control chamber pressure may be reduced and the combustion chamber pressure may cause said sleeve to slide and thereby delivery fuel from said delivery chamber through said delivery passage to said combustion chamber while said coil is energized, and wherein said valve seat member is adjustable relative to said stop to establish the rate of fuel delivery through said delivery passage.

3. An injector for delivering fuel directly to an engine combustion chamber, said injector including a housing, a piston in said housing, a sleeve closing one end of said housing and surrounding one end of said piston and thereby defining a control chamber between said sleeve and said housing and a delivery chamber between said sleeve and said piston, said sleeve having an end adapted for exposure to the pressure in said combustion chamber and being adapted to slide relative to said piston and said housing and thereby increase the pressures in said control and delivery chambers upon an increase in pressure in said combustion chamber, said housing having a supply passage connected to said control and delivery chambers for supplying fuel thereto, a valve seat member disposed in said supply passage, a magnetically responsive control valve responsive to the difference between the control chamber pressure and the supply pressure for engaging said valve seat member and obstructing flow from said control chamber to said passage upon an increase in the control chamber pressure, said sleeve having a delivery passage extending from said delivery chamber and adapted to open to said combustion chamber, an injection valve disposed in said delivery passage for inhibiting flow therethrough, said injection valve being responsive to the delivery chamber pressure for permitting delivery of fuel through said delivery passage to said combustion chamber upon an increase in the delivery chamber pressure, and a coil adjacent said control valve and energizable for creating a magnetic field to displace said control valve from said valve seat member against a stop and permit flow from sad control chamber to said supply passage, whereby the control chamber pressure may be reduced and the combustion chamber pressure may cause said sleeve to slide and thereby deliver fuel from said delivery chamber through said delivery passage to said combustion chamber while said coil is energized, wherein said valve seat member is adjustable relative to said stop to establish the rate of fuel delivery through said delivery passage, and wherein said control valve is responsive to the difference between the supply passage pressure and the control chamber pressure for permitting flow from said supply passage to said control and delivery chambers upon a decrease in the control chamber pressure, whereby said control valve may be displaced to fill said control and delivery chambers with fuel without energizing said coil.

4. The method of operating an injector for delivering fuel directly to an engine combustion chamber, said injector including a housing, a piston in said housing, a sleeve closing one end of said housing and surrounding one end of said piston and thereby defining a control chamber between said sleeve and said housing and a delivery chamber between said sleeve and said piston, said sleeve having an end adapted for exposure to the pressure in said combustion chamber and being adapted to slide relative to said piston and said housing and thereby increase the pressures in said control and delivery chambers upon an increase in pressure in said combustion chamber, said housing having a supply passage connected to said control and delivery chambers for supplying fuel thereto, a magnetically responsive control valve responsive to the difference between the control chamber pressure and the supply passage pressure for obstructing flow from said control chamber to said passage upon an increase in the control chamber pressure, said sleeve having a delivery passage extending from said delivery chamber and adapted to open to said combustion chamber, an injection valve disposed in said delivery passage for inhibiting flow therethrough, said injection valve being responsive to the delivery chamber pressure for permitting delivery of fuel through said delivery passage to said combustion chamber upon an increase in the delivery chamber pressure, and a coil adjacent said control valve and energizable for creating a magnetic field to displace said control valve to permit flow from said control chamber to said supply passage, whereby the control chamber pressure may be reduced and the combustion chamber pressure may cause said sleeve to slide and thereby deliver fuel from said delivery chamber through said delivery passage to said combustion chamber while said coil is energized, said method comprising the step of deenergizing said coil to interrupt delivery of fuel from said delivery chamber through said delivery passage to said combustion chamber.

5. The method of operating an injector for delivering fuel directly to an engine combustion chamber, said injector including a housing, a piston in said housing, a sleeve closing one end of said housing and surrounding one end of said piston and thereby defining a control chamber between said sleeve and said housing and a delivery chamber between said sleeve and said piston, said sleeve having an end adapted for exposure to the pressure in said combustion chamber and being adapted to slide relative to said piston and said housing and thereby increase the pressures in said control and delivery chambers upon an increase in pressure in said combustion chamber, said housing having a supply passage connected to said control and delivery chambers for supplying fuel thereto, a magnetically responsive control valve responsive to the difference between the control chamber pressure and the supply passage pressure for obstructing flow from said control chamber to said passage upon an increase in the control chamber pressure, said sleeve having a delivery passage extending from said delivery chamber and adapted to open to said combustion chamber, an injection valve disposed in said delivery passage for inhibiting flow therethrough, said injection valve being responsive to the delivery chamber pressure for permitting delivery of fuel through said delivery passage to said combustion chamber upon an increase in the delivery chamber pressure, and a coil adjacent said control valve and energizable for creating a magnetic field to displace said control valve to permit flow from said control chamber to said supply passage, whereby the control chamber pressure may be reduced and the combustion chamber pressure may cause said sleeve to slide and thereby deliver fuel from said delivery chamber through said delivery passage to said combustion chamber while said coil is energized, said method comprising the steps of energizing said coil to initiate delivery of fuel from said delivery chamber through said delivery passage to said combustion chamber, maintaining said coil energized for the time required to deliver the desired amount of fuel to said combustion chamber, and deenergizing said coil to terminate delivery of fuel from said delivery chamber through said delivery passage to said combustion chamber.

6. The method of calibrating an injector for delivering fuel directly to an engine combustion chamber, said injector including a housing, a piston in said housing, a sleeve closing one end of said housing and surrounding one end of said piston and thereby defining a control chamber between said sleeve and said housing and a delivery chamber between said sleeve and said piston, said sleeve having an end adapted for exposure to the pressure in said combustion chamber and being adapted to slide relative to said piston and said housing and thereby increase the pressures in said control and delivery chambers upon an increase in pressure in said combustion chamber, said housing having a supply passage connected to said control and delivery chambers for supplying fuel thereto, a valve seat member disposed in said supply passage, a magnetically responsive control valve responsive to the difference between the control chamber pressure and the supply passage pressure for engaging said valve seat member and obstructing flow from said control chamber to said passage upon an increase in the control chamber pressure, said sleeve having a delivery passage extending from said delivery chamber and adapted to open to said combustion chamber, an injection valve disposed in said delivery passage for inhibiting flow therethrough, said injection valve being responsive to the delivery chamber pressure for permitting delivery of fuel through said delivery passage to said combustion chamber upon an increase in the delivery chamber pressure, and a coil adjacent said control valve and energizable for creating a magnetic field to displace said control valve from said valve seat member against a stop and permit flow from said control chamber to said supply passage, whereby the control chamber pressure may be reduced and the combustion chamber pressure may cause said sleeve to slide and thereby deliver fuel from said delivery chamber through said delivery passage to said combustion chamber while said coil is energized, and wherein said valve seat member is adjustable relative to said stop to establish the rate of fuel delivery through said delivery passage, said method comprising the steps of energizing said coil to initiate delivery of fuel from said delivery chamber through said delivery passage to said combustion chamber, and adjusting the position of said valve seat member relative to said stop to establish the rate of fuel delivery through said delivery passage.

* * * * *